US008708607B2

(12) United States Patent
Kenny

(10) Patent No.: US 8,708,607 B2
(45) Date of Patent: Apr. 29, 2014

(54) ROCK BOLT WITH MECHANICAL ANCHOR

(75) Inventor: Matthew Kenny, Hamilton (AU)

(73) Assignee: Sandvik Intellectual Property AB, Sandviken (SE)

( * ) Notice: Subject to any disclaimer, the term of this patent is extended or adjusted under 35 U.S.C. 154(b) by 433 days.

(21) Appl. No.: 12/672,232

(22) PCT Filed: Jul. 9, 2008

(86) PCT No.: PCT/SE2008/000441
§ 371 (c)(1),
(2), (4) Date: Dec. 20, 2011

(87) PCT Pub. No.: WO2009/029013
PCT Pub. Date: Mar. 5, 2009

(65) Prior Publication Data

US 2012/0114426 A1 May 10, 2012

(51) Int. Cl.
*E21D 20/00* (2006.01)
*E21D 21/00* (2006.01)

(52) U.S. Cl.
CPC ..... *E21D 21/0046* (2013.01)
USPC ..... 405/259.4

(58) Field of Classification Search
USPC ..... 405/259.1, 259.4, 259.5
See application file for complete search history.

(56) References Cited

U.S. PATENT DOCUMENTS 3,247,754 A * 4/1966 Bieser ..... 411/29
4,100,748 A * 7/1978 Hansen ..... 405/259.3
4,160,614 A * 7/1979 Koval ..... 405/259.3
4,369,003 A * 1/1983 Brandstetter ..... 405/259.3
4,437,795 A * 3/1984 White ..... 405/259.3
4,557,631 A * 12/1985 Donan et al. ..... 405/259.3
4,611,954 A * 9/1986 Cassidy ..... 405/259.6
4,655,644 A * 4/1987 Lane et al. ..... 405/259.5

(Continued)

FOREIGN PATENT DOCUMENTS

RU 796485 A1 1/1981
RU 909199 A1 2/1982
RU 977810 A1 11/1982
WO WO 2007/053893 5/2007

OTHER PUBLICATIONS

Decision on Grant for Russian Patent Application No. 2010112394/03(017345), dated Jun. 19, 2012 (with translation).

*Primary Examiner* — Sunil Singh
*Assistant Examiner* — Patrick Lambe
(74) *Attorney, Agent, or Firm* — Morgan, Lewis & Bockius LLP

(57) ABSTRACT

A rock bolt comprising a shaft having first and second ends, and an anchoring device operative to retain the bolt when located in a drilled hole and comprising a mandrel mounted to, or integrally formed with, the shaft and at least one expansion element overlaying the mandrel, at least one of the mandrel or the at least one expansion element being a movable member and being able to rotate relative to, and move axially along, the shaft, the at least one expansion element being arranged to be displaced radially outwardly on a predetermined relative movement between the mandrel and the at least one expansion element, wherein when disposed on a first portion of the shaft, rotation of the movable member relative to the shaft causes axial movement of that member along the shaft, and when disposed on a second portion of the shaft, the movable member is able to rotate on the shaft without being biased to move axially along the shaft.

34 Claims, 3 Drawing Sheets

(56) References Cited

U.S. PATENT DOCUMENTS

| | | | | | |
|---|---|---|---|---|---|
| 4,764,055 | A * | 8/1988 | Clark et al. | 405/259.2 |
| 4,861,197 | A * | 8/1989 | Calandra, Jr. | 405/259.3 |
| 4,990,042 | A * | 2/1991 | Szayer et al. | 411/29 |
| 5,009,549 | A * | 4/1991 | Stankus | 405/259.5 |
| 5,028,188 | A * | 7/1991 | Prince | 411/67 |
| 5,073,065 | A * | 12/1991 | Kleineke | 405/259.6 |
| 5,076,733 | A * | 12/1991 | Frease | 405/259.1 |
| 5,183,357 | A * | 2/1993 | Palm | 411/29 |
| 5,275,512 | A * | 1/1994 | Wright | 405/259.6 |
| 5,297,909 | A * | 3/1994 | Tsay et al. | 411/29 |
| 5,501,551 | A * | 3/1996 | Wright | 405/259.4 |
| 7,179,020 | B2 * | 2/2007 | Robertson, Jr. | 405/259.4 |
| 7,896,580 | B2 * | 3/2011 | Weaver et al. | 405/259.4 |
| 2006/0018721 | A1 * | 1/2006 | Robertson | 405/259.4 |
| 2008/0038068 | A1 * | 2/2008 | Craig | 405/259.3 |
| 2010/0098500 | A1 * | 4/2010 | Weaver et al. | 405/259.1 |
| 2010/0202838 | A1 * | 8/2010 | Weaver et al. | 405/259.1 |
| 2011/0103896 | A1 * | 5/2011 | Horsch et al. | 405/259.1 |

* cited by examiner

ROCK BOLT WITH MECHANICAL ANCHOR

This application is a §371 National Stage Application of PCT International Application No. PCT/SE2008/000441, filed Jul. 9, 2008, and claims priority under 35 U.S.C. §119 and/or §365 to Australian Application No. 2007214343, filed Aug. 31, 2007.

TECHNICAL FIELD

The present invention relates to rock bolts suitable for use in the mining and tunneling industry to provide roof and wall support and to shafts for use in such rock bolts. The invention is suitable for use in hard rock applications as well as in softer strata, such as that often found in coal mines, and it is to be appreciated that the term "rock" as used in the specification is to be given a broad meaning to cover both these applications.

BACKGROUND

Roof and wall support is vital in mining and tunneling operations. Mine and tunnel walls and roofs consist of rock strata, which must be reinforced to prevent the possibility of collapse. Rock bolts are widely used for consolidating the rock strata.

In conventional strata support systems, a hole is drilled into the rock by a drill rod, which is then removed and a rock bolt is then installed in the drilled hole and secured in place typically using a resin or cement based grout.

Self drilling rock bolts have also been proposed whereby the bolt is also used as the drill rod. As such, with a self drilling rock bolt, the hole can be drilled and the bolt installed in a single pass.

In both conventional rock bolts and self drilling rock bolts, mechanical anchoring devices are often incorporated on the bolt to retain the bolt in place when located in a drilled hole. To ensure correct installation, anchoring devices should not be prone to inadvertently activate or fail to activate when required.

SUMMARY OF THE INVENTION

In accordance a first aspect of with the present invention, there is provided a rock bolt comprising a shaft having first and second ends, and an anchoring device operative to retain the bolt when located in a drilled hole and comprising a mandrel mounted to, or integrally formed with, the shaft and at least one expansion element overlaying the mandrel, at least one of the mandrel or the at least one expansion element being a movable member and being able to rotate relative to, and move axially along, the shaft, the at least one expansion element being arranged to be displaced radially outwardly on a predetermined relative movement between the mandrel and the at least one expansion element, wherein when disposed on a first portion of the shaft, rotation of the movable member relative to the shaft causes axial movement of that member along the shaft, and when disposed on a second portion of the shaft, the movable member is able to rotate on the shaft without being biased to move axially along the shaft.

In a particular form, the second portion is adjacent the first portion. Further in one form, the movable member is connected to the shaft along the first portion via a threaded coupling comprising an external thread on the shaft and a complementary inner thread disposed on an inner surface of the member. The external thread of the shaft may terminate at the second portion, and the movable member may be able to move between the first and second portions by being wound off or onto the external thread of the shaft.

To facilitate engagement of the movable member with the external thread when on the second portion of the shaft, the second portion may extend axially along the shaft a distance that is slightly larger than the axial length of the inner thread of the member. In this way, the movable member remains close to the end of the external thread.

In accordance with a particular form of rock bolt the movable member is able to adopt different states. In a first state, the movable member may rotate and be biased to move axially. In a second state, the movable member may rotate without axial bias. This ability to be able to adopt these different states may be utilised to assist in preventing inadvertent activation of the anchor assembly and/or reduce the likelihood of the anchoring device failing to activate when required.

In one form, the mandrel is mounted to the shaft and comprises the movable member. Further, the at least one expansion element and the mandrel may be connected to the bolt shaft in a manner that allows them to be rotatable relative to the shaft about the bolt axis. Furthermore, in at least one form, the inner surface of the at least one expansion element and an external inclined surface(s) of the mandrel are shaped so that relative rotation between the at least one expansion element and the mandrel is prevented. As such, the at least one expansion element and the mandrel rotate together about the bolt shaft.

In a particular form of the above mentioned arrangement, on rotating the shaft relative to the anchoring device, the at least one expansion element is restrained from axial movement along the bolt shaft, whereas the mandrel is movable axially along the shaft in a direction that causes outward displacement of the at least one expansion element. Accordingly, with this configuration, rotation of the shaft relative to the anchoring device induces relative movement between the at least one expansion element and the mandrel to cause the radial outward displacement of the at least one expansion element.

In a particular form, movement of the mandrel down the shaft (i.e. towards the second end) causes the at least one expansion element to be displaced radially outwardly.

In one form, where the at least one expansion element is restrained from axial movement along the shaft, this expansion element may be restrained at one end of the at least one expansion element thereby allowing the remainder of the expansion element to extend radially outwardly. In one form, the at least one expansion element may be seated in a groove disposed about the shaft or may be captured by a retaining collar disposed about the shaft.

In one form, the expansion element projects downwardly from the restrained end towards the second end of the rock bolt. In another form, the expansion element projects upwardly towards the first end of the rock bolt. In this latter arrangement, the at least one expansion element may be located in a groove, or bear against a retaining collar disposed on the shaft at a location spaced from the first end.

In a particular form, a plurality of expansion elements is provided which in use are angularly spaced about the shaft axis. In a particular form, a connector is provided which interconnects the expansion elements and which is arranged to engage with the bolt shaft so as to prevent the axial movement of the expansion elements along the shaft. In one form, this connector may be formed in multiple pieces, or is able to be deformed, so as to extend about and locate in a recess in the shaft.

In an alternative arrangement to the above, the expansion elements are formed as a single piece which incorporates a central aperture. In this arrangement, the central region of the piece that incorporates the aperture forms an integral connector.

In a particular embodiment, the second portion is disposed on the shaft adjacent the connector so as to prevent the mandrel from being biased by rotating about the shaft to move into engagement with the connector which could otherwise inhibit it's ability to rotate and allow effective deployment of the anchoring device.

In a particular form, the connector is captured at the first end of the shaft. In a particular form, the second portion is disposed at the first end of the shaft and is arranged to restrict the amount the mandrel is caused to move beyond the first end by rotating about the shaft.

In a particular form, the bolt is arranged for use as a self drilling rock bolt and further comprises a drill tip formed on, or connected to, the first end of the shaft and a drive formed on, or connected to, the shaft at or adjacent the second end and arranged to be connected to a drilling apparatus to allow rotation of, and thrust to, the bolt.

According to one form, there is provided a self drilling rock bolt comprising a shaft having first and second ends, a drill tip formed on, or connected to, the first end of the shaft, a drive formed on, or connected to, the shaft at or adjacent the second end arranged to be connected to a drilling apparatus to allow rotation of, and thrust to the bolt, and an anchoring device operative to retain the bolt when located in a drilled hole and comprising a mandrel mounted to, or integrally formed with, the shaft and at least one expansion element overlaying the mandrel, at least one of the mandrel or the at least one expansion element being a movable member and being able to rotate relative to, and move axially along, the shaft, the at least one expansion element being arranged to be displaced radially outwardly on a predetermined relative movement between the mandrel and the at least one expansion element, wherein when disposed on a first portion of the shaft, rotation of the movable member relative to the shaft causes axial movement of that member along the shaft, and when disposed on a second portion of the shaft, the movable member is able to rotate on the shaft without being biased to move axially along the shaft.

In a particular form, the bolt is rotatable about an axis of the bolt in a first direction in a drilling operation and is rotated in an opposite second direction to cause the predetermined movement between the mandrel and the at least one expansion element so as to enable the anchoring device to become operative to retain the bolt in a drilled hole.

In one form, the self drilling rock bolt incorporates an inner passage within the shaft. The shaft is typically made from steel and this passage provides part of a circulation passage to allow drilling fluid to be introduced, or withdrawn, at the first end of the bolt and to enable grout to be pumped into the drilled hole to set the rock bolt in place. Typically the circulation passage further includes a second passage that is formed between the bolt shaft and the wall surface of the drilled hole.

The hollow shaft may be formed by various techniques. In a particular embodiment, the shaft is formed from an elongate metal section that is folded over so that opposite longitudinal edges of the metal section are brought into contact to form the seam. One such hollow rod of this form is manufactured and supplied by OneSteel Pty Ltd and uses a steel section. Such construction of hollow rod has the advantage that it can be made relatively inexpensively and therefore is ideally suited for applications such as in self-drilling rock bolts where the bolt is for single use. In another form, the shaft is formed from a steel tube.

In another form, the shaft may be solid along at least a portion of its length and a sleeve is arranged to extend about that portion to provide a passage between the shaft and sleeve. This passage in turn forms part of the circulation passage.

In one form, the drill tip extends radially from the bolt axis a distance greater than the shaft to provide the passage between the shaft and the wall of the drilled hole. In one form, the drill tip is located directly on the shaft of the bolt, which may be modified to accept the drill tip such as through a milling or forging operation.

In an alternative form, the rock bolt further comprises a drill bit which is connected to an end of the shaft and which incorporates the drill tip thereon. In this arrangement, the drill bit is connected to the end of the shaft by a coupling that is arranged to impart rotation to the drill bit from the shaft when the shaft is rotated in at least one direction. In this regard, the coupling may be permanent i.e. the drill bit may be welded on to the shaft, or alternatively the drill bit may be removable. In this latter arrangement, the coupling may be in the form of interfitting projections and recesses that allow rotation to be imparted or alternatively a threaded coupling may be used wherein the drill bit incorporates a shank having an external thread and a complementary inner thread is disposed on an inner surface of the shaft.

In one form, the expansion element, typically through the connector, may be designed to be captured between the drill bit and the shaft end so as to restrain the expansion element from axial movement.

In a particular form, the rock bolt further comprises a drive disposed adjacent to the second end and which is designed to interengage with the drilling apparatus. The drive is also connected to the shaft so as to allow rotation of and thrust to be imparted to the bolt shaft.

In a particular form, the drive is in the form of a drive nut which is connected to the bolt shaft through a threaded coupling comprising an external thread disposed on the shaft and a complementary inner thread disposed on an inner surface of the drive nut.

In a particular form, a stop is provided which is operative to inhibit axial movement of the drive nut beyond a predetermined location on the shaft. In a particular form, this stop is in the form of a torque device which is arranged to restrict axial movement of the drive nut along the shaft until a predetermined torque is supplied to the nut. In a particular form, this torque device is in the form of a torque pin which extends radially through the nut and into the shaft, and wherein the torque pin is operative to shear on the application of a predetermined torque to the nut.

In a further aspect of the invention, there is provided a rock bolt shaft extending along an axis between first and second ends comprising a first portion incorporating a threaded external surface arranged to form part of threaded coupling with a member having a complementary internal thread, and a second portion disposed adjacent to the first potion, the second portion being shaped to receive the member so as to allow the member to rotate on the shaft without inducing axial movement of the member along the shaft.

In one form, the second portion is located adjacent the first end of the shaft.

In one form, the second portion has a plain external surface and is circular in cross section.

In a particular form, the shaft incorporates an interior passage that extends to the first end. In one form the interior passage incorporates an internal thread which extends to the first end of the shaft.

In one form, a third portion of the shaft which is spaced from the first portion includes a threaded external surface. In a particular form, the handing of the thread on the first and third portions is the same.

In a particular form, the third portion is located adjacent the second end of the shaft.

In operation of a particular embodiment of the self drilling rock bolt, the bolt is secured to a drilling apparatus, via the drive nut, which rotates the rock bolt in the first direction. The mandrel is positioned on the second portion of the shaft and is able to freely spin with the expansion element(s) during this drilling operation. In particular there is no facility for the mandrel to wind over the first end of the shaft which would force the connector into the drill bit and therefore bind those components together. Drilling fluid is pumped to the first end to flush the cutting surface of the rock bolt.

On completion of the drilling phase, the drilling apparatus then rotates the bolt in the opposite direction which causes activation of the anchoring device and in a particular form causes the mandrel to engage the external thread on the shaft to move axially into the first portion of the shaft and to cause the expansion element(s) to expand.

In a particular form, the threaded coupling for both the mandrel and the drive nut has the same handed thread. With this arrangement, on rotation in the second direction, the drive nut rotates with the shaft as relative movement is prevented by the torque pin, thereby causing the shaft to rotate in the second direction. The expansion element(s) are caused to directly grip the bore wall to induce the expansion element(s) to slip. This relative movement induced between the anchoring device and the shaft causes the mandrel to wind down the thread of the shaft thereby causing the expansion elements to displace radially outwardly to move into tighter engagement with the rock surface of the drilled hole.

When the expansion elements are firmly engaged with the wall surface, the bolt becomes firmly held in place. Accordingly if need be the drilling apparatus can be detached and at some later time grout can be injected into the hole to set the bolt in place.

The bolt can also be placed in tension at that time by continuing to apply torque in the second direction to the drive nut. At a particular point, the expansion elements are forced so hard against the rock wall surface that the wedge cannot move down the shaft any further. This then effectively binds the bolt and inhibits it from rotating any further. This builds up the torque at the drive nut until it reaches a point where it will shear the torque pin thereby allowing the drive nut to move relative to the shaft. This relative movement then causes the nut to wind up the shaft.

Once the drive nut is able to move along the bolt shaft, it will then move into engagement with the outer face of the rock strata (either directly or through a bearer plate) which will then enable the bolt to be placed in tension as the distance of the bolt between the drive nut and the anchoring device is shortened. This places the rock strata in compression. Once the bolt is under sufficient tension, the drilling apparatus can then be removed and the final stage of setting the bolt in place by the introduction of the grout through the inner passage of the bolt can then be performed.

BRIEF DESCRIPTION OF THE DRAWINGS

It is convenient to hereinafter describe an embodiment of the present invention with reference to the accompanying drawings. The particularity of the drawings and the related description is to be understood as not superseding the generality of the preceding broad description of the invention.

In the drawings.

DETAILED DESCRIPTION OF THE DRAWINGS

Figure 1:
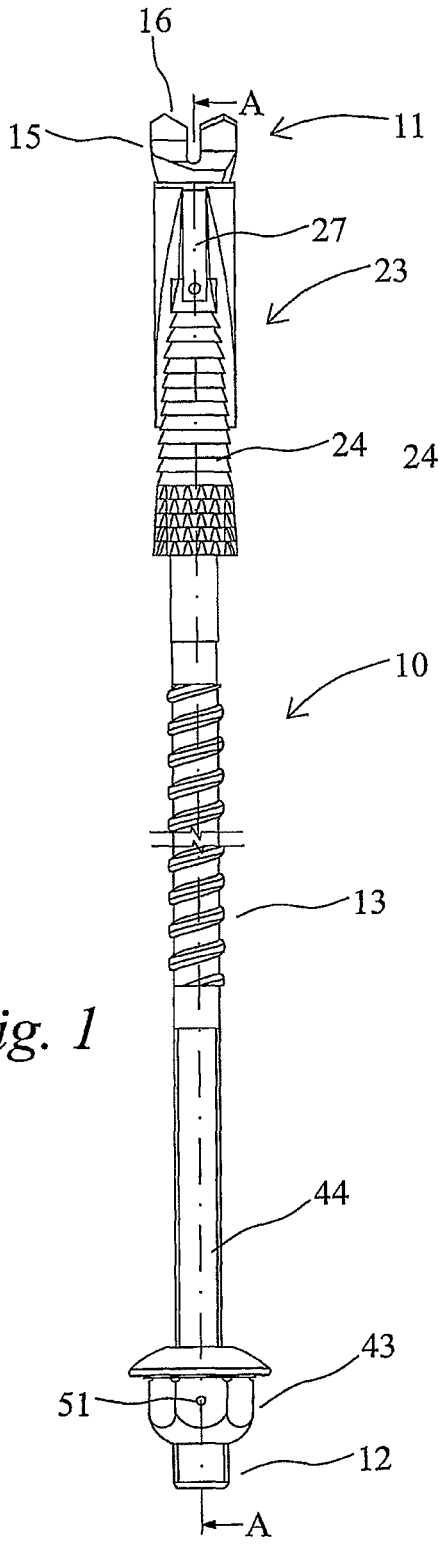
FIG. 1 is a side elevation of a self drilling rock bolt.
Figure 2:
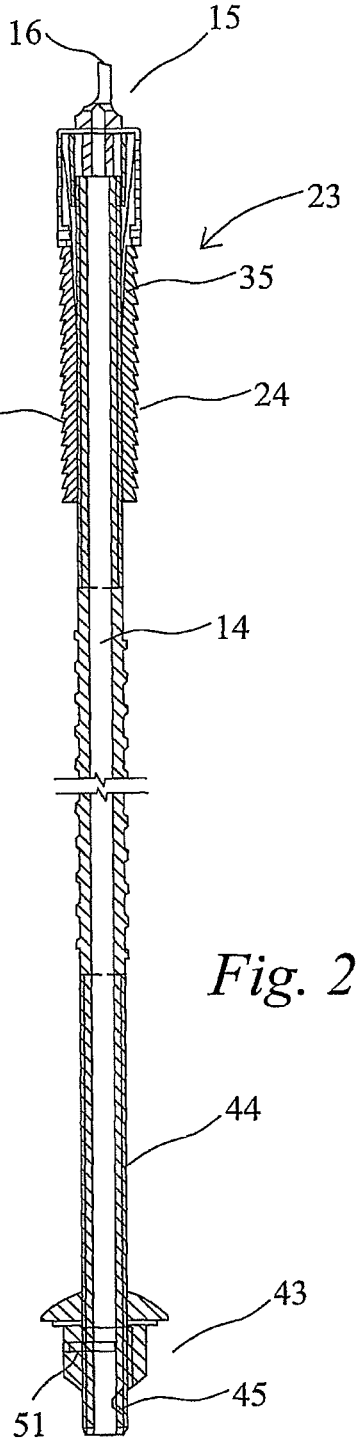
FIG. 2 is a sectional view along section lines A-A of the bolt of FIG. 1.
Figure 5:
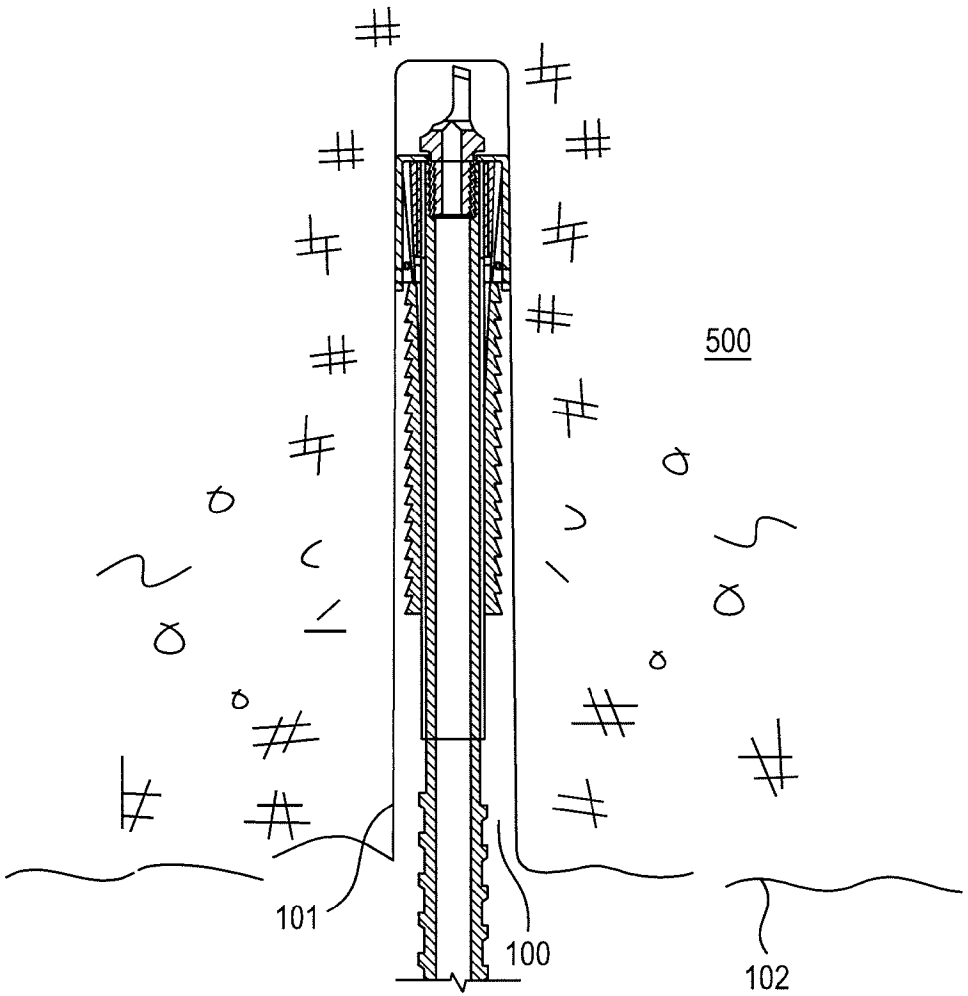
FIG. 5 is a sectional view of the first end of the rock bolt of FIG. 1 while drilling in rock strata.

FIGS. 1 and 2 illustrate a self drilling rock bolt 10 which incorporates a first (drilling) end 11 and a second (nut) end 12 and a shaft 13 which extends between the opposite ends 11, 12. The shaft 13, which is typically made from steel, is hollow and incorporates a central passage 14 which allows fluid to be passed from the nut end 12 to the drilling end 11. In use, the self drilling rock bolt 10 is connected to a drilling apparatus (not shown) and acts as a drill rod to drill a hole 100 (see FIG. 5) into rock strata 500. Thereafter, the rock bolt 10 is secured in place as will be explained in more detail below to provide support for the rock strata 500.

The drilling end 11 incorporates a drill bit 15 incorporating a drill tip 16 at a distal end thereof and an anchoring device 23 which in use is arranged to retain the bolt in a drilled hole. The anchoring device 23 may be used to retain the bolt 10 in the drilled hole so as to temporarily secure the rock bolt in place prior to the introduction of grout into the hole 100 or to permanently fix the bolt in place and/or to tension the bolt so as to place the rock strata 500 in compression.

Figure 3:
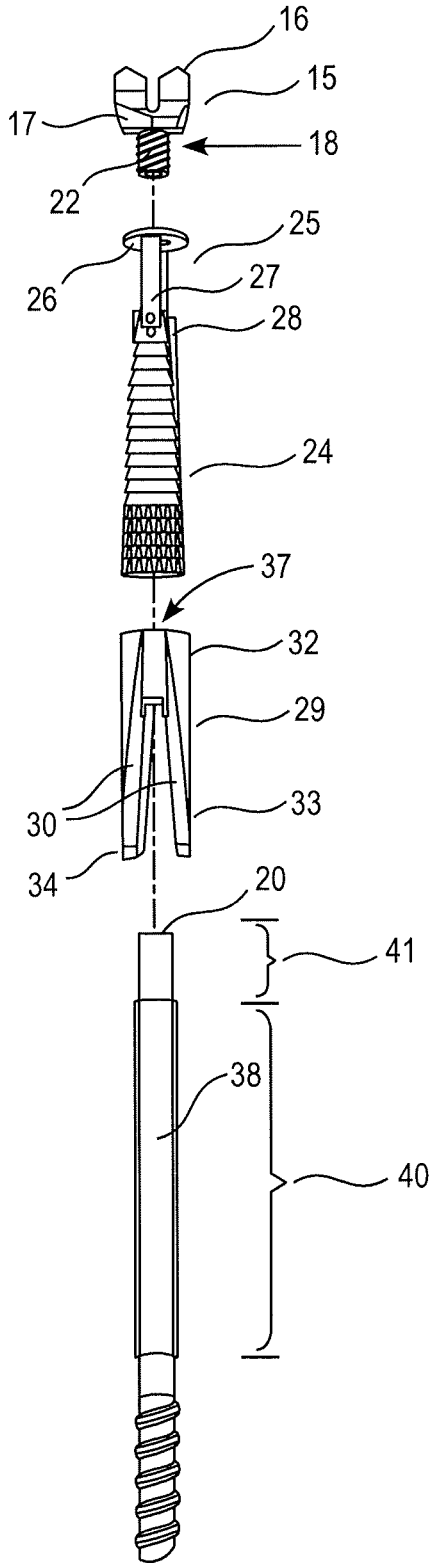
FIG. 3 is an exploded perspective view of the first end of the rock bolt of FIG. 1.
Figure 4:
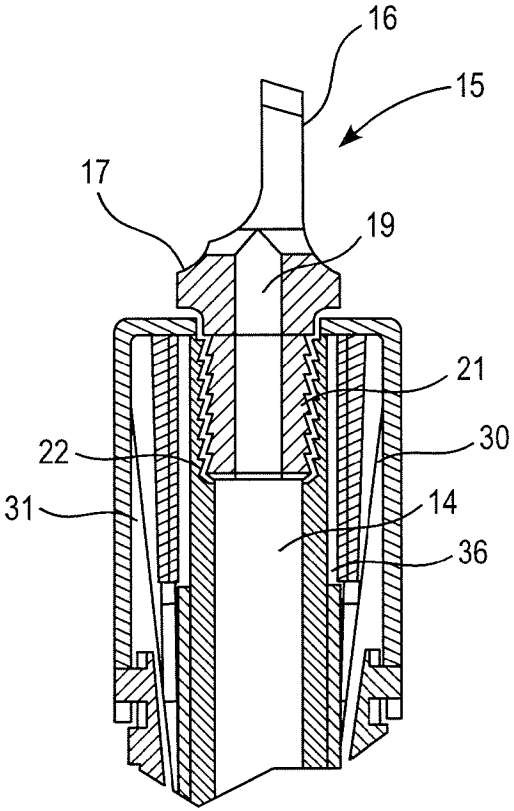
FIG. 4 is a sectional view to an enlarged scale of the first end of the rock bolt of FIG. 1.

The details of the drilling end 11 are best seen in FIGS. 3 and 4. The drill bit 15 includes a bit body 17 which includes the drill tip 16 at its outer end and a drill bit shank 18 which incorporates an external thread 22 on its outer surface. A passage 19 extends from the distal tip of the shank 18 through to the distal end of the bit body 17. This passage 19 is arranged to be in fluid communication with the passage 14 of the shaft when the drill bit 15 is secured to the shaft end 20. The shaft end 20 includes an inner thread 21 (see FIG. 4) which is complementary to the external thread 22 on the drill bit shank 18. As such, the drill bit 15 can be simply screwed on to shaft end 20 of the shaft 13.

During a drilling operation, the drilling apparatus typically induces right hand rotation to the drill shaft. To ensure that the drill bit 15 does not separate from the shaft during the drilling operation, the threaded coupling between the drill bit 15 and the shaft 13 is a right handed thread so as to tend to cause the threaded coupling between the drill bit and shaft to tighten during a drilling operation.

The anchoring device 23 is disposed below the drill bit 15 and includes a pair of expansion elements 24 which are designed to be caused to move outwardly from a retracted position as illustrated in the drawings to an expanded condition (not shown) wherein the expansion elements 24 engage the wall 101 of the drilled hole 100.

The expansion elements 24 are interconnected by a connector or bail strap 25. This connector is typically made from spring steel and includes a body section 26 and connecting legs 27. The connecting legs 27 are welded (or otherwise fixed) to a proximal end 28 of the expansion elements 24. By making the connector 25 from spring steel, it can flex thereby providing a live hinge that allows pivoting of the expansion elements so as to enable it to easily move between its retracted and its extended position.

In use, the body 26 of the connector is arranged to be captured between the drill bit 15 and shaft end 20 in a manner that allows the expansion elements to rotate about the shaft axis 20 but prevents them from moving axially along the bolt shaft. This can be achieved by providing a sufficiently large space between the drill bit 15 and the shaft end 20 when the bit is fully secured in place to ensure that the connector is held loosely between those components.

The anchoring device 23 further includes a mandrel 29 which in the illustrated form includes opposite inclined surfaces 30 and 31. The mandrel 29 includes a head portion 32 and two depending legs 33 and 34 with opposite faces of the head portion 32 and opposite edge surfaces of the legs 33 and 34 forming respective ones of the inclined surfaces 30 and 31.

The mandrel is axially movable on the shaft 13 and is able to adopt different states depending on its position on the shaft. When on a first portion 40 of the shaft 13 (as best illustrated in FIG. 3), rotation of the mandrel relative to the shaft 13 causes a corresponding axial movement of the mandrel along the shaft. This occurs by way of a threaded coupling between the shaft and mandrel in this first portion of the shaft. The threaded coupling includes an internal thread 36 formed in an inner bore 37 in the head portion 32 of the mandrel 29 and an external thread 38 formed on the bolt shaft 13.

The threaded coupling between the mandrel 29 and the bolt shaft 13 is a left handed thread so that when the rock bolt is undergoing rotation which is counter to the direction of drilling (i.e. left hand rotation of the shaft), any relative motion between the mandrel and the shaft would cause the mandrel to move towards the nut end 12. Further, the mandrel is arranged so that the inclined surfaces 30 and 31 are designed to abut with inner surfaces 35 of the expansion elements 24 in a manner such that relative movement of the mandrel towards the nut end 12 of the shaft causes the expansion elements to move from their retracted position to their extended position.

The mandrel is also able to locate in a second portion 41 of the shaft which is immediately adjacent the first portion 40 of the shaft and extends to the end 20 of the shaft. This second portion has a plain external surface (in contrast to the threaded first portion 40) which is circular in cross-section and is designed to allow the mandrel to freely rotate on the shaft without inducing any axial movement of the mandrel on the shaft.

The length of the second portion 41 is only slightly larger than the head 32 of the mandrel. In this way the mandrel 29 remains close to the start of the thread 38 disposed on the first portion 40.

During drilling of the bolt 10, the mandrel is arranged to be located on the second portion 41 of the shaft where it is able to freely spin. In particular under the right handed rotation during drilling, any relative rotation of the mandrel would be in a direction opposite to the thread 38 so there is no tendency for the mandrel to engage the thread and wind down onto the first portion. Also there is not tendency for the mandrel to be biased to move axially towards the shaft end 20 which would cause the mandrel to force the bail strap 25 into the underside of the drill bit which could effectively bind those components together and prevent later activation of the anchoring device when the mandrel undergoes counter rotation.

The nut end 12 of the rock bolt 10 includes a drive 43 disposed adjacent to the end 12 and arranged to inter-engage with the drilling apparatus and the shaft so as to allow rotation and thrust to be imparted to the bolt shaft. The drive 43 is in the form of a drive nut which is connected to the bolt shaft 13 through a threaded coupling comprising external thread 44 disposed on the shaft 13 and a complementary inner thread 45 disposed on an inner surface of the drive nut.

The threaded coupling in the illustrated form is a left handed thread so that during a drilling operation, the torque applied to the drive nut tends to cause it to wind off the second end of the shaft 13. To prevent this, a torque pin 51 is provided which is arranged to restrict relative movement of the drive nut on the shaft until a predetermined torque is supplied to the nut. The torque pin 51 extends radially through the nut 47 and into the shaft 13 (as best illustrated in FIG. 2), and is operative to shear on the application of a predetermined torque to the nut.

In operation, the bolt 10 is secured to a drilling apparatus, via the drive nut 43 which rotates the rock bolt in the first direction. Drilling fluid is pumped through the circulation passage of the bolt to flush the cutting surface of the rock bolt. In this position the mandrel 29 is disposed on the second portion of the shaft and is able to spin freely with the expansion elements 24 without inducing any axial movement towards the shaft end 20.

On completion of the drilling phase, the drilling apparatus then rotates the bolt in the opposite direction. The drive nut 43 rotates with the shaft as relative movement is prevented by the torque pin. This opposite rotation is arranged to induce "slip" in the expansion elements 24 and mandrel 29 relative to the bolt shaft. This relative movement induced between the anchoring device and the shaft causes the mandrel to engage the thread 28 and move from the second portion 41 of the shaft onto the first portion 40 as it winds down the thread of the shaft. This movement causes the expansion elements to displace radially outwardly to engage the rock surface of the drilled hole.

When the expansion elements are engaged with the wall surface, the bolt becomes firmly held in place. Accordingly if need be, the drilling apparatus can be detached and at some later time grout can be injected into the hole to set the bolt in place.

The bolt can also be placed in tension at this stage by continuing to apply torque in the second direction to the drive nut 43. At a particular point, the expansion elements 24 are forced so hard against the rock wall surface that the wedge cannot move down the shaft any further. This then effectively binds the bolt and inhibits it from rotating any further. This builds up the torque at the drive nut 43 until it reaches a point where it will shear the torque pin 51 thereby letting the drive nut move relative to the shaft. This relative movement then causes the nut to wind up the shaft.

Once the drive nut is able to move along the bolt shaft, it will then move into engagement with the outer face 102 of the rock strata 500 (either directly or through a bearer plate) which will then enable the bolt to be placed in tension as the effective length of the bolt between the drive nut and the anchoring device is shortened. This places the rock strata in compression. Once the bolt is under sufficient tension, the drilling apparatus can then be removed and the final stage of setting the bolt in place by the introduction of the grout through the inner passage of the bolt can then be performed as required.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

Variations and/or modifications may be made to the parts previously described without departing from the spirit or ambit of the invention.

The disclosures in the Australian patent application No. 2007214343, from which this application claims priority, are incorporated herein by reference.

The invention claimed is:

1. A rock bolt comprising a shaft having a first end region, a second end region and a center region joining the first end region and the second end region, and an anchoring device operative to retain the bolt when located in a drilled hole and comprising a mandrel mounted to, or integrally formed with, the shaft and at least one expansion element overlaying the mandrel, wherein each of the first end region and the second end region includes a first portion with a thread on an outer surface and a second portion without a thread on the outer surface, and the second unthreaded portion is axially outward of the first threaded portion, wherein at least one of the mandrel or the at least one expansion element is a movable member and is able to rotate relative to, and move axially along, the shaft, the at least one expansion element being arranged to be displaced radially outwardly on a predetermined relative movement between the mandrel and the at least one expansion element, wherein when disposed on the first threaded portion of the shaft, rotation of the movable member relative to the shaft causes axial movement of that member along the shaft, and when disposed on the second unthreaded portion of the shaft, the movable member is able to rotate relative to the outer surface of the shaft without being biased to move axially along the shaft.

2. A rock bolt according to claim 1, wherein the second unthreaded portion is adjacent the first threaded portion.

3. A rock bolt according to claim 1, wherein the movable member is connected to the shaft along the first threaded portion via a threaded coupling comprising an inner thread disposed on an inner surface of the member that is complementary to the thread on the outer surface of the first threaded portion.

4. A rock bolt according to claim 3, wherein the thread on the outer surface of the first portion terminates at the second unthreaded portion, and wherein the movable member is able to move between the first and second portions by being wound off or onto the thread on the outer surface of the first portion.

5. A rock bolt according to claim 3, wherein the second unthreaded portion extends axially along the shaft a distance that is slightly larger than the axial length of the inner thread of the movable member.

6. A self drilling rock bolt according to claim 3, wherein the drive is in the form of a drive nut which is connected to the bolt shaft through a threaded coupling comprising an external thread disposed on the shaft and a complementary inner thread disposed on an inner surface of the drive nut, and wherein the threaded couplings of the movable member and the drive nut to the shaft have the same handing.

7. A rock bolt according to claim 1, wherein the movable member is the mandrel and the at least one expansion element is restrained from axial movement along the bolt shaft.

8. A rock bolt according claim 7, wherein the anchoring device further comprises a connector and the at least one expansion element depends from the connector, and wherein the connector is captured in a manner that prevents axial movement of the at least one expansion element along the shaft whilst allowing the connector to rotate about the shaft.

9. A rock bolt according to claim 8, wherein the second unthreaded portion is disposed on the shaft adjacent the connector so as to prevent the movable member from being biased by rotating about the shaft to move into engagement with the connector.

10. A rock bolt according to claim 8, wherein the connector is captured at the first end region of the shaft.

11. A rock bolt according to claim 10, wherein the connector is captured by a retaining collar disposed on the shaft.

12. A rock bolt according to claim 1, wherein the second unthreaded portion is disposed at the first end region of the shaft and is arranged to restrict the amount the movable member is caused to move beyond the first end region by rotating about the shaft.

13. A rock bolt according to claim 1, wherein the predetermined relative movement is movement of the mandrel relative to the at least one expansion element in a direction axially along the shaft towards the second end region.

14. A rock bolt according to claim 1, wherein the at least one expansion element and the mandrel are restrained from relative rotation about the shaft axis by engagement of at least one inclined surface of the mandrel with an inner surface of the at least one expansion element.

15. A rock bolt according to claim 1, wherein the bolt is arranged for use as a self drilling rock bolt and further comprises a drill tip formed on, or connected to, the first end region of the shaft and a drive formed on, or connected to, the shaft at or adjacent the second end region and arranged to be connected to a drilling apparatus to allow rotation of, and thrust to the bolt.

16. A self drilling rock bolt according to claim 15, wherein the bolt is rotated about the shaft axis in a first direction in a drilling operation and is rotated in an opposite second direction to cause the predetermined movement between the mandrel and the at least one expansion element so as to enable the anchoring device to become operative to retain the bolt in a drilled hole.

17. A self drilling bolt according to claim 15, wherein the bolt is arranged to allow fluid to be passed between the ends of the shaft when located in a drilled hole.

18. A self drilling rock bolt according to claim 15, wherein the shaft incorporates an inner passage to allow fluid to be passed between a first end of the shaft and a second end of the shaft.

19. A self drilling rock bolt according to claim 15, wherein the drill tip extends radially a distance greater than the radius of the shaft to provide a passage to convey fluids between the shaft and the wall of the drilled hole.

20. A self drilling rock bolt according claim 15, further comprising a drill bit which is connected to a first end of the shaft and incorporates the drill tip thereon, the drill bit being connected to the first end of the shaft by a coupling that is arranged to impart rotation to the drill bit from the shaft when the shaft is rotated in at least one direction.

21. A self drilling rock bolt according to claim 20, wherein the coupling between the drill bit and the shaft comprises a threaded coupling having an external thread on a shank of the drill bit and a complementary inner thread disposed on an inner surface of the shaft.

22. A self drilling rock bolt according to claim 15, wherein the drive is in the form of a drive nut which is connected to the bolt shaft through a threaded coupling comprising an external thread disposed on the shaft and a complementary inner thread disposed on an inner surface of the drive nut.

23. A self drilling rock bolt according to claim 22, further comprising a torque device operative to restrict axial movement of the drive nut along the shaft until a predetermined torque is applied to the nut.

24. A self drilling rock bolt according to claim 23, wherein the torque device is in the form of a torque pin which extends radially through the nut and into the shaft, the torque pin being operative to shear on the application of a predetermined torque to the nut.

25. A rock bolt shaft extending along an axis and comprising a first end region and a second end region, and a center region located axially between the first end region and the second end region, wherein at least one of the first end region and the second end region include a first portion and a second portion, the second portion being axially outward of the first portion, wherein the first portion of the shaft incorporating a threaded external surface is arranged to form part of a threaded coupling with a member having a complementary internal thread, and wherein the second portion of the shaft is disposed adjacent to the first portion and is shaped to receive the member so as to allow the member to rotate relative to the outer surface of the shaft without inducing axial movement of the member along the shaft.

26. A rock bolt shaft according to claim 25, wherein the second portion extends to an end of the shaft.

27. A rock bolt shaft according to claim 25, wherein the second portion has a plain external surface and is circular in cross-section.

28. A rock bolt shaft according to claim 25, wherein a passage extends from a first end of the shaft and incorporates a threaded internal surface.

29. A rock bolt shaft according to claim 25, wherein the shaft is hollow and incorporates a passage which extends between opposite first and second ends of the shaft.

30. A rock bolt shaft according to claim 25, wherein a third portion of the shaft, spaced axially inward from said second portion, incorporates a threaded external surface.

31. A rock bolt shaft according to claim 30, wherein the external threads on the first and third portion have the same handing.

32. A rock bolt shaft according to claim 25, wherein both the first end region and the second end region each include a first portion and a second portion.

33. A self drilling rock bolt comprising a shaft having first and second ends, a drill tip formed on, or connected to, the first end of the shaft, a drive formed on, or connected to, the shaft at or adjacent the second end arranged to be connected to a drilling apparatus to allow rotation of, and thrust to the bolt, and an anchoring device operative to retain the bolt when located in a drilled hole and comprising a mandrel mounted to, or integrally formed with, the shaft and at least one expansion element overlaying the mandrel, at least one of the mandrel or the at least one expansion element being a movable member and being able to rotate relative to, and move axially along, the shaft, the at least one expansion element being arranged to be displaced radially outwardly on a predetermined relative movement between the mandrel and the at least one expansion element, wherein when disposed on a first portion of an end region of the shaft, rotation of the movable member relative to the shaft causes axial movement of that member along the shaft, and when disposed on a second portion of the end region of the shaft, the movable member is able to rotate on the shaft without being biased to move axially along the shaft, and wherein the second portion of the end region is axially outward from the first portion of an end region.

34. The self drilling rock bolt according to claim 33, wherein the first end of the shaft is a drilling end, wherein the first portion of the end region has a first outer surface that is threaded and a second portion of the end region has a second outer surface that is unthreaded, the second portion located at a drilling end of the shaft and the first portion adjacent to the second portion, and wherein when disposed on a first portion of the shaft, rotation of the movable member relative to the shaft causes axial movement of that member along the threaded first outer surface of the shaft, and when disposed on the second portion of the shaft, the movable member is disengaged from the threaded first outer surface of the shaft.

* * * * *